United States Patent [19]

DiBuono

[11] Patent Number: 4,564,956

[45] Date of Patent: Jan. 21, 1986

[54] GOLF GLOVE WITH RAIN SHIELD

[76] Inventor: Dominick DiBuono, 12 Richmond Hill Rd., Greenwich, Conn. 06830

[21] Appl. No.: 573,282

[22] Filed: Jan. 23, 1984

[51] Int. Cl.[4] ..... A41D 13/08

[52] U.S. Cl. ..... 2/16; 2/158; 2/161 A

[58] Field of Search ..... 2/16, 19, 158, 159, 2/160, 161 R, 161 A, 162, 164

[56] References Cited

U.S. PATENT DOCUMENTS

| | | | |
|---|---|---|---|
| 2,436,755 | 2/1948 | Lapell | 2/161 A |
| 2,497,749 | 2/1950 | Wagner | 2/16 |
| 2,603,790 | 7/1952 | Boehm-Myro | 2/158 |
| 3,203,005 | 8/1965 | Burrows | 2/158 |
| 3,430,265 | 3/1969 | Mazza | 2/162 |
| 4,195,405 | 4/1980 | Monk | 2/158 |

*Primary Examiner*—Werner H. Schroeder
*Assistant Examiner*—J. L. K. Olds
*Attorney, Agent, or Firm*—Kuhn Muller and Bazerman

[57] ABSTRACT

A combination glove for a golfer or baseball player which has a special water-resistant covering fitted over an inner glove for the purpose of maintaining the glove, and the player's non-gloved hand, dry when the player is playing in the rain.

3 Claims, 3 Drawing Figures

GOLF GLOVE WITH RAIN SHIELD

BACKGROUND OF THE INVENTION

This invention relates to golf apparel and, more particularly, to a combination golf glove and protective shield which is designed to keep the glove and the golfer's non-gloved hand dry when the golfer is playing in the rain.

A golf glove is often worn by a golfer in order to enable the golfer to exert a better grip of the upper handle of a golf club. In golf, only one hand is typically gloved and the other hand is bare (ungloved) even though both hands are interlocked about the golf club shaft in connection with the execution of a swing or stroke of the club. Golf gloves are designed to provide a skin-tight fit. Thus, better gloves usually have a longitudinal slit which cuts across the wrist band of the glove to respectively facilitate the ready placement and removal of the glove onto and from the hand. Various types of closure means have been used to close the slit when the glove is worn by a golfer. It is quite important that the golfer's grip be uniformly applied to the handle and maintained throughout the course of the golfer's backswing and follow-through as deviations in the force applied to the handle or physical contact between the glove or the ungloved hand and the handle will result in hooking or slicing of the ball. Many golfers avidly play despite inclement weather conditions and, in particular, golfers will often begin or continue a game of golf while it is raining. Under such conditions, the golfer's glove, the ungloved hand and the handle of the club become wet. This has a number of undesirable effects. The lubricant effect of a film of water between the glove or ungloved hand and the club's handle, for instance, interferes with the maintenance of a firm grip and may cause movement of the club relative to the hands thereby destroying the effectiveness of the swing. Further, the golfer may tend to over compensate for the wet lubricating effect by more strenuously gripping the handle. However, it is more difficult for the golfer to cnsistently gauge the extra force which he must exert, particularly throughout 18-hole game, since it is above and beyond the usual, and presumably more comfortable force which the golfer typically applies under sunny weather conditions. The application of extraordinary force, in addition, tends to more readily fatigue the player and strain or cramp the players critical arm muscles.

The invention is designed to provide a means for avoiding the conditions which detrimentally effect golfing in the rain. The invention is described in relation to golf, but may also be used for other sports, such as baseball. Thus, the invention may be used in gripping a baseball bat.

SUMMARY OF THE INVENTION

According to the present invention (which is herein described in relation to golf, but may be used for other sports), a golf glove is fitted with an outer covering having a first opening to permit the shaft of a golf club or baseball bat to extend through it. The covering is preferably made of a flexible material such as a water-resistant fabric treated with a water-proofing compound for the purpose of keeping the glove dry when the golfer is playing in the rain.

A preferred feature of the invention comprises a slit formed through the side of the covering to allow the insertion of the golfer's ungloved hand to also protect it from the elements.

Thus in accordance with a preferred embodiment of the invention, a rain-protected glove, particularly for gripping a handle of a golf club, comprises a covering substantially circumscribing the glove with the upper end of the covering attached to the periphery of the open end of the wrist band, and an aperture in the lower end of the cover for closely receiving and passing the golf club or baseball bat therethrough.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
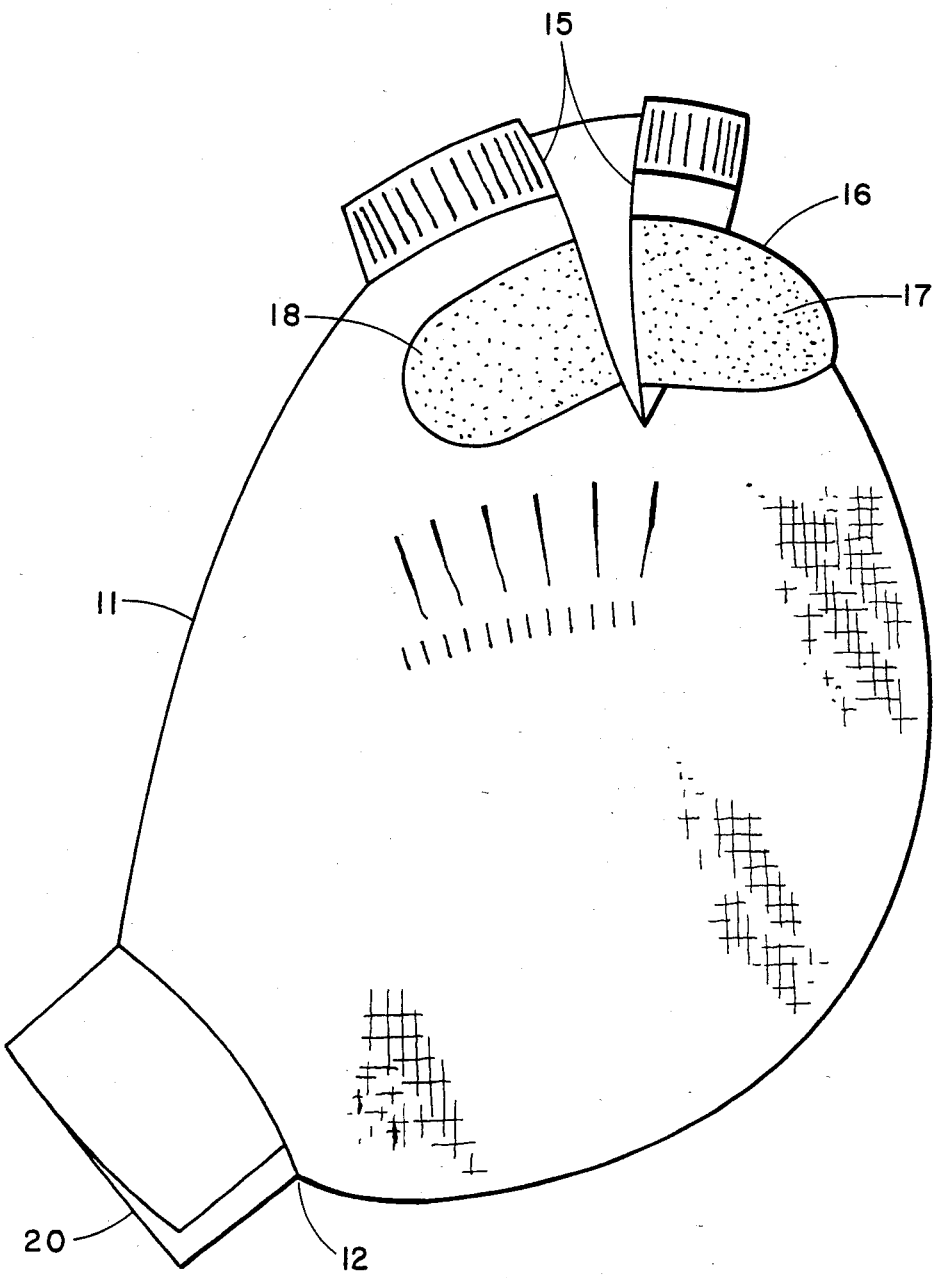
FIG. 1 is a left-side view of a combination and rain shield glove constructed in accordance with the invention.
Figure 2:
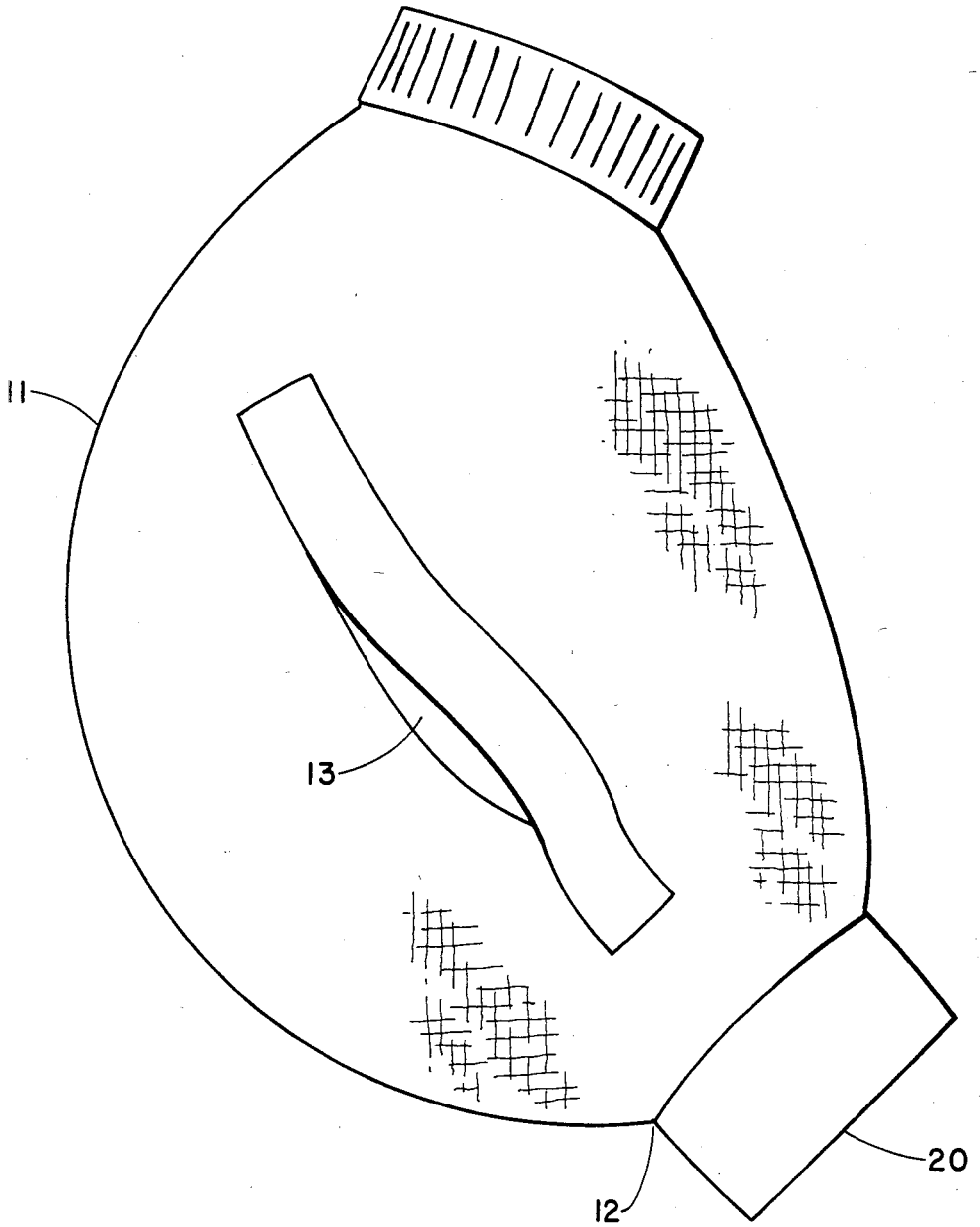
FIG. 2 is a right-side view of the invention of FIG. 1.
Figure 3:
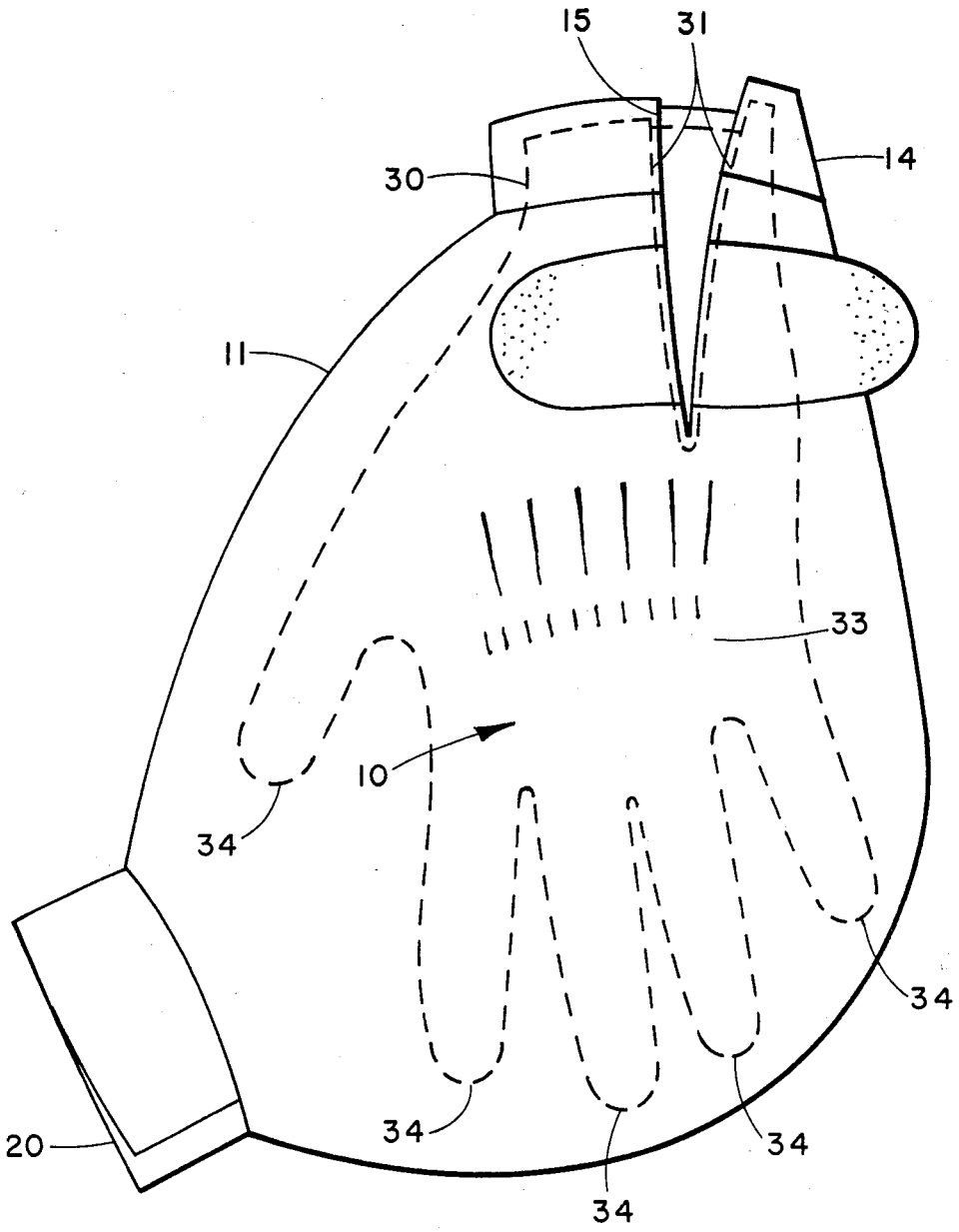
FIG. 3 is a left-side view of the device of FIG. 1 with the inner glove shown in phantom so as to illustrate the inner golf glove and its connection to the outer rain shield.

Referring now to the drawings there is shown a preferred embodiment of a combination golf glove and rain shield according to the invention. The combination comprises a conventional golf glove 10 and a shield composed of an outer bag or covering 11 attached to the glove along the periphery of the wrist band 30 of the glove that generally circumscribes the wrist of the wearer. The glove includes a palm section 33 attached to the wrist band and finger sleeves 34 attached to the section 33.

The bottom edge of the lower end 12 of the outer covering 11 includes an aperture 20 through which end of a golf club can be passed.

The shield preferably includes an elongated side slot 13. The slot 13 is located on the side opposite to the hand of the glove, that is, the slot 13 is provided on the left-side of the covering when a right-handed glove is used or, alternatively, the slot 13 is provided on the right-side of the covering when a left-handed glove is utilized. Although less preferable, it would be possible to provide a slot on both the left and right-handed sides of the covering when utilizing a universal type glove, that is, a glove that is capable of accommodating either a left or right hand. The covering should be sufficiently large and loose to permit the golfer to comfortably grip the handle of the club with both hands without the covering interfering with the golfer's serving.

It is important that both the glove and the covering be firmly attachable to the wrist of the golfer. Thus, in the preferred embodiment the upper end 14 of the covering 11 is sewingly fixed to the upper periphery or wrist band 30 of the glove 10. Moreover, the covering is providing with a slot 15 which extends longitudinally, that is, substantially parallel to the arm of the golfer. The edges of the covering adjacent to the slot 15 preferably overlie, in a superjacent manner, and are fixed substantially adjacent to the edges 31 of the glove adjacent to the similar slot within the wrist band portion of the glove. A strap 16 is attached to the covering at one side of the covering and extends across the slot 15 to the other side. Locking means 17, 18 are provided on the strap and the covering to allow the covering and the glove to be adjustably and firmly bound to the wrist of the golfer. The closure means in the illustrated embodiment comprise Velcro brand interlocking strips but functionally equivalent types of closures, for example, snap-on buttons or strap and buckle arrangements could also be utilized.

While preferable, the covering itself does not have to be sewably fixed to the glove. The covering could, for example, be removably attached about the periphery of the glove's wrist band by the use of Velcro brand interlocking strips. This type of structural arrangement allows separation of the covering and glove so that the glove may be used without the rain shield so that the rain shield can be used without the glove, or so that either the covering or glove, or both, can be cleaned.

By way of illustration, without limiting the invention, it is noted that the covering can be, and is preferably, made from a water-proofed fabric or a water-resistant material such as a thin vinyl sheet.

In operation, a golfer places his hand into the glove through the opening at the upper end of the glove and the covering. The strap is pulled across the slot and fixed to the opposite side of the covering to tighten and secure the covering and glove to the wrist of the golfer. The golfer selects an appropriate golf club and extends the handle end through the aperture 20 and grips the club handle with his gloved hand. The golfer then inserts the ungloved hand through the slot 13 to grip the club handle with both hands in the normal manner. The ungloved hand can, of course, also be placed within the covering at times when the club is not engaged to protect it from the elements and to keep the ungloved hand warm.

As used in the claims, "club" includes a baseball bat or other athletic device on which a player normally uses two hands.

I claim:

1. A combination covering and glove for use in the rain and comprising:

an inner glove having a wrist band, a palm section attached to the wrist band, and a plurality of finger sleeves attached to the palm section; an outer covering surrounding said inner glove and having an upper wrist surrounding end sewingly fixed to the periphery of the said wrist band and a lower end with an opening for receiving the handle of an athletic club, said inner glove including an elongated slit longitudinally extending through the wrist band, and said outer covering including a slit longitudinally extending from the upper wrist surrounding end, the edges of the slit of the outer covering being connected to edges of the slit in the inner glove; and wherein said outer covering has an elongated slot on the lateral side thereof which is adjacent to the palm portion of said inner glove; said slot extending toward and in the same direction as the central axis of the said opening for the athletic club, whereby the user may pass a second ungloved hand through said slot to grasp said club in cooperation with a hand in the inner glove.

2. The combination covering and glove of claim 1 including a strap fixedly connected to one edge of the outer covering slit, the strap having a free end extendable over the outer covering slit to the other edge of the outer covering slit, and means for connecting the strap to the other edge of the outer covering slit.

3. The combination covering and glove of claim 1 wherein the outer covering is composed of a flexible material which is water resistant.

* * * * *